US007490550B2

(12) United States Patent
Kärsten et al.

(10) Patent No.: US 7,490,550 B2
(45) Date of Patent: Feb. 17, 2009

(54) METHOD FOR CHECKING IMPOSITIONS FOR PRINTING PAGES

(75) Inventors: Toivo Kärsten, Skogas (SE); Jagdev Rehal, Skogas (SE)

(73) Assignee: Somitrack AB, Skogas (SE)

( * ) Notice: Subject to any disclaimer, the term of this patent is extended or adjusted under 35 U.S.C. 154(b) by 0 days.

(21) Appl. No.: 10/916,507

(22) Filed: Aug. 12, 2004

(65) Prior Publication Data

US 2005/0066831 A1 Mar. 31, 2005

(30) Foreign Application Priority Data

Aug. 13, 2003 (SE) ..... 0302214

(51) Int. Cl.
*B41F 1/54* (2006.01)

(52) U.S. Cl. ..... 101/484; 399/401; 400/189; 101/463.1; 101/481; 101/485; 101/486

(58) Field of Classification Search ..... 101/484, 101/453, 224, 288, 463.1, 485, 486, 481; 400/621.1, 579, 188, 189; 358/1.18; 359/296; 399/14, 15, 364, 401; 270/1.01
See application file for complete search history.

(56) References Cited

U.S. PATENT DOCUMENTS 3,739,968 A * 6/1973 Bodendoerfer ..... 226/30
4,019,435 A 4/1977 Davis ..... 101/232
4,136,862 A * 1/1979 Kunz et al. ..... 271/186
4,623,900 A 11/1986 Watanabe ..... 347/218
4,636,872 A * 1/1987 Prichard ..... 358/296
4,900,001 A * 2/1990 Lapeyre ..... 270/1.01
4,903,043 A 2/1990 Tajima ..... 346/134
4,984,773 A * 1/1991 Balban et al. ..... 270/5.01
4,988,088 A * 1/1991 Aiba ..... 271/186

(Continued)

FOREIGN PATENT DOCUMENTS

EP 0367628 A2 5/1990

(Continued)

OTHER PUBLICATIONS

Helmut Kipphan, Handbook of Print Media, Apr. 2000, pp. 228, and 532-540.*

*Primary Examiner*—Leslie J Evanisko
*Assistant Examiner*—Matthew G Marini
(74) *Attorney, Agent, or Firm*—Birch, Stewart, Kolasch & Birch, LLP

(57) ABSTRACT

A method for checking a correctness of impositions and correct mutual register of the print pages at a front side and a rear side of different types of printed matters using a check print apparatus comprising two co-operating printers. The method includes preparing impositions in a control unit of the front side and the rear side of a print original to be made, printing a plurality of print pages having a first imposition of the front side of the paper, printing a plurality of print pages having a second imposition on the rear side of the paper with the page in position turned 180°, checking that the first and second impositions of the front and rear sides coincide, correcting the first and second impositions using the control unit when the checking step determines the first and second impositions do not coincide, and preparing a print original with the first and second impositions coinciding.

10 Claims, 1 Drawing Sheet

U.S. PATENT DOCUMENTS

| | | | | | |
|---|---|---|---|---|---|
| 5,326,011 | A * | 7/1994 | Mager et al. | 226/181 |
| 5,461,469 | A * | 10/1995 | Farrell et al. | 399/407 |
| 5,488,458 | A * | 1/1996 | Benedict et al. | 399/15 |
| 5,625,766 | A * | 4/1997 | Kauffman | 382/294 |
| 5,634,091 | A * | 5/1997 | Sands et al. | 358/1.18 |
| 5,634,187 | A * | 5/1997 | Ross | 399/365 |
| 6,068,418 | A * | 5/2000 | Fox | 400/579 |
| 6,267,518 | B1 * | 7/2001 | Abe | 400/188 |
| 6,659,602 | B2 * | 12/2003 | Izawa et al. | 347/102 |
| 6,729,780 | B2 * | 5/2004 | Sampson et al. | 400/74 |
| 6,782,817 | B2 * | 8/2004 | Izawa et al. | 101/223 |
| 6,821,038 | B2 * | 11/2004 | Izawa | 400/621.1 |
| 6,916,132 | B2 * | 7/2005 | Otsuka et al. | 400/621 |
| 6,950,206 | B1 * | 9/2005 | Karsten et al. | 358/1.18 |
| 2002/0105571 | A1 * | 8/2002 | Izawa et al. | 247/104 |
| 2002/0171871 | A1 * | 11/2002 | Catt et al. | 358/1.18 |
| 2003/0118388 | A1 * | 6/2003 | Sampson et al. | 400/579 |
| 2004/0190065 | A1 * | 9/2004 | Shimizu | 358/1.18 |

FOREIGN PATENT DOCUMENTS

| | | | |
|---|---|---|---|
| EP | 0 835 761 | A2 * | 10/1997 |
| EP | 835761 | A2 * | 4/1998 |
| SE | 515052 | C2 | 6/2001 |
| SE | 518 052 | * | 8/2002 |

* cited by examiner

METHOD FOR CHECKING IMPOSITIONS FOR PRINTING PAGES

This Non-provisional application claims priority under 35 U.S.C. § 119(a) on patent application No(s). 0302214-2 filed in Sweden on Aug. 13, 2003, the entire contents of which are hereby incorporated by reference.

BACKGROUND OF THE INVENTION

1. Field of the Invention

The present invention relates to a method and an apparatus for use, in the first place, within the reproduction area in the graphic industry, and more particularly for improving and simplify the possibility of preparing printing plates and print originals having correct impositions and mutual register between the sides of the front page and the rear side page for various types of printing systems.

2. Discussion of the Background

When printing any kinds of printed matters there are generally printed several pages at the same time, for instance 4, 8, 16, 32 or 64 pages on one and the same sheet, firstly with half the number of pages on one side, called the front side, and thereafter with the second half number of pages on the opposite side, called the rear side. The sheets, having been printed on both sides, are folded, are eventually joined, bound and are guillotined to form a ready printed matter.

When planning the design of the printed matter to be made the print pages have to be place according to a very accurate imposition, both so that the pages of the print sheet, after the printed matter has been folded are presented in a chronologic order, and also so that the pages on the front page and the rear page of the printed matter, that is odd and even pages, are placed exactly straight over each other. As an aid for making the layout and the succession of pages of the printed sheet correct it is necessary that the imposition is checked before the printing plates are prepared and the printing process is started. Depending on how the sheet is folded the impositions may vary. A possible example of imposition of the front and rear sides of a 16 page printing sheet is shown in FIGS. 1A and 1B.

Primarily the word "imposition" means that, for instance, 8 pages (16, 32, 64 etc) are placed in such order of a printing sheet to be printed and having a predetermined size, that the printed pages, after the sheet has been folded following in a chronologic order, so that, for instance in a 16 page sheet, the pages 1, 4, 5, 8, 9, 12, 13 and 16 are placed on the front side of the printed sheet, whereas the pages 2, 3, 6, 7, 10, 11, 14 and 15 are placed on the rear side of the sheet, and, in front of all, that the pages on the front side and rear side, respectively, are located exactly straight over each other. To that end a check print is made of the front side and the rear side of one and the same printing sheet. This is done in that a first print is made of the front page of the printing sheet, and that a second print is made of the front page of the printing sheet, and that a second print is made of the rear side of the same printing sheet, whereupon a check is made of the placing and the mutual registers of the print pages. The printing of the rear side is made after the print sheet has been turned upside down. In this connection it is of greatest importance that the print sheet is fed into the check print apparatus with an exactly correct alignment. The check printing can be made on separate sheets or from a roll of check print paper. In case of eventual misalignments between the sides a correction of the impositions must be made.

In conventional printing processes according to modem methods there are used computers for creating print pages comprising text and images. A print page is what can be seen in a book, a catalogue, a newspaper etc. Digital dates for such pages are treated in several stages resulting in a so called imposition. An imposition defines the position of each page of a printing sheet, which generally consists of 8, 16, 32 or 64 print pages. The position of each page including digital data is determined both by the printing machine, for instance an office printing machine, a gravure printing press, or in some cases a letterpress printing machine, by means of which the printing sheet is printed, and also by the way in which the print sheet is folded after having been printed. Since the printing is made on both sides of the paper there is a need for two separate impositions. A first imposition comprises digital data for printing on the front page of the print sheet, and a second imposition comprising data for printing on the rear side of the print sheet.

Methods and apparatus for printing of paper both on the front side and on the rear side are known from several different patent publications, like from U.S. Pat. No. 4,623,900, U.S. Pat. No. 4,903,043, U.S. Pat. No. 4,019,435 or from EP 367.628. In all said cases there is question of making prints or copies on both sides of a paper. There is in no case question of checking of imposition for instance for printing plates. Therefore there are no specific means for foreseeing that a paper is fed exactly correct into the printing machine in connection to printing of the front and rear sides.

In most methods, used so far, for checking the impositions it has been possible to check only one side, and this is unsatisfactory since the rear side (the completing side) is missing at the check print, and it is therefore no possibility of checking that the impositions of the front page and the rear page, respectively, of one and the same printing sheet coincide with each other.

SE518.052 having the same applicant as in the present application discloses a method and an apparatus for checking impositions whereby both the front side and the rear side are printed on one and the same printing sheet. The printing is made on separate sheets which are cut from a roll of paper. For directing the print sheet into the printer unit it is foreseen that the sheet to be printed is fed with the long sides thereof in an exactly correct position. For that purpose is used a type of buckling means, which foresees that the front edge of the print sheet, after the print sheet has been buckled, is let free so that the sheet is fed into the printing unit exactly aligned with respect to the side edges of the sheet. In the apparatus there are used two printer units, one unit for the front side of the sheet and an other printer unit for the rear side of the sheet. Aligning by means of buckling must be done at both printer units. Depending on the long transport path for the cut off sheet, which passes in the form of the numeral "8", there appear problems with the straightening up of the sheet, in particular in connection to printing in the second printer unit, in which the "rear side" is printed.

SUMMARY OF THE INVENTION

For making it possible to print from paper received from a toll of paper in connection to the imposition checking it is an advantage that the print sheet, upon printing or print-out of both the front side and the rear side on one and the same sheet is fed into the printer unit or the test printing is fed into the printer unit or the test printer apparatus with the front edge of the sheet is lined up into exactly the same position upon printing or print-out of the printing pages of the front page and the rear page of the sheet In this connection it is important that the sheet is given the shortest possible moving path between the printer unit for the "front side" and the printer unit for the "rear side", so that the paper has no possibility of twisting when being positioned in the printer unit for the rear side.

According to the invention this is done in a test print apparatus comprising two identical printer units which are positioned above each other and which are rotated 180° in relation to each other, and which has a short guiding path between the two printer units, and in which the paper which has been printed on the "front side" is fed from the upper printer unit in a short guide path directly down to the second printer unit and places itself in direct contact with a feeder stop of the lower printer unit, whereupon the sheet is printed on the "rear side" in said second printer unit.

The method according to the invention involves the steps of

- feeding a paper from a roll of paper by means of a roll feeder,
- feeding the paper as far as to transport and pinch rolls in a first, upper printer unit and pinching said paper between said rolls,
- moving computer data to a printer unit of the a first printer,
- printing the paper on one side, here referred to as the "front side",
- cutting off the paper from the roll and directing same with the front edge in a short guiding path directly down to the second printer,
- stopping the front edge of the paper using stop means provided by transport and pinch rolls in the second printer,
- feeding the cat off sheet of paper, which has been turned upside down in the guide path, in said upside down position, from the stop means of the second printer, whereby the said reference edge as in the first printer will be the reference edge also in the second printer,
- transferring data to a printer unit of the second printer, in this case with the amount of data for the rear side rotated 180°,
- printing the rear side of the print sheet,
- after having been printed the paper printed on both sides is let free and can be checked with reference to the impositions and the correct registers between the front and rear sides.

The most important advantages of the invention is that

- the paper is always guided by the same front edge of the roll means as of the sheet,
- correct register is obtained in that the paper is fed by the same front edge, referred to as reference front edge, both in the first and in the second printer,
- the guiding path for the transportation of the paper sheet between the first and the second printer is so short and straight that there can not be any substantial rotation of the sheet during the passage between the first and the second printers,
- there is no need for turning the paper upside down, in particular since the "rear side" is printed as being rotated 180°,
- one and the same type of standard printers can be used for printing of both the "front side" and the "rear side" of the check print sheet,
- the paper roll from which the print sheet is cut off has such large diameter that no substantial curling can appear in the paper, or alteratively an anti-curling means can be provided in front of the feeding place for the paper in the first printer.

DETAILED DESCRIPTION OF THE INVENTION

Figure 1A:
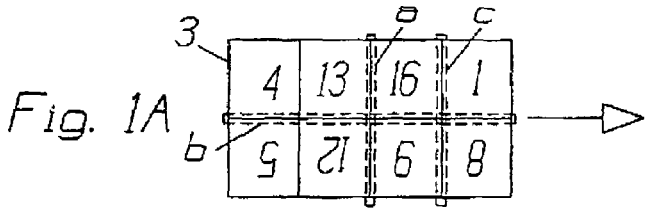
FIG. 1*a* shows an imposition of the pages in the "front side"
Figure 1B:
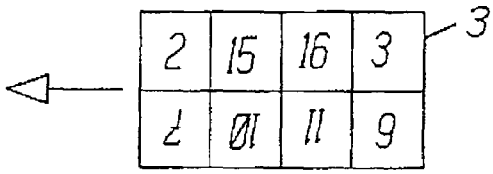
FIG. 1*b* shows an imposition of the pages in the "rear side" of the same sheet.
Figure 2:
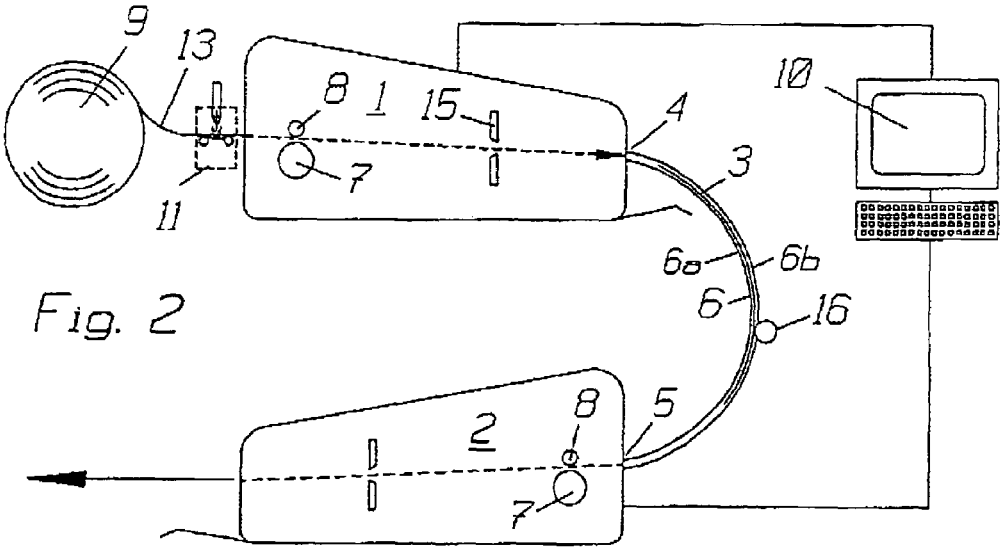
FIG. 2 shows the check print apparatus.
Figure 3:
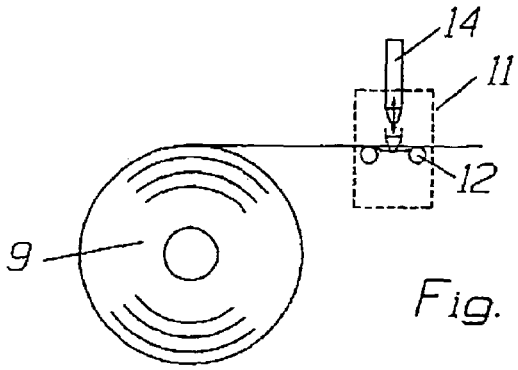
FIG. 3 shows a simple means for providing anti-curling of a paper.

Further advantages and characteristics will be evident from the following detailed specification in which reference will be made to the accompanying drawings. In the drawings FIG. 1A shows an imposition of the pages in the "front side" of a 16 page printing sheet, and FIG. 1B shows the imposition of the pages in the "rear side" of the same sheet. FIG. 2 diagrammatically, and in a vertical projection, shows the check print apparatus according to the invention. FIG. 3 diagrammatically and likewise in a vertical projection, and in an enlarged scale, shows a simple means for providing anti-curling of a paper pulled out from the paper roll.

The apparatus comprises two identical standard printers of whatever known type, for instance of the type ink-jetprinter, 1 and 2, which are mounted straight above each other, but which are rotated 180° in the horizontal plane so as to form a complete unit for double sided printing of check print sheets. The upper printer unit 1 is intended to be used for printing of the "front side", see FIG. 1A, of a check print paper 3 in the direction to the right as shown in FIG. 1, whereas the lower printer unit 2 is intended for printing of the "rear side", see FIG. 1B of the same check print paper 3, in the direction to the left as shown in FIG. 2. Between the exit 4 of the upper printer 1 and the entrance 5 of the lower printer 2 there is a closed guide path 6 having a front side 6*a* and a rear side 6*b*, in which guide path the check print sheet 3, which has been printed on the front side, is adapted to slide down and be placed in a position ready for printing of the "rear side" of the check print sheet in the lower printer 2. The guide path 6 is so short and so encapsulated that a check print sheet 3 can not rotate during the passage in the guide path 6, and normally there is no need for "buckling" of the printing sheet at the entrance of the lower printer 2.

At the entrance each printer unit has a stop means which is formed by a transport roll 7 and a pinch roll 8 which, when receiving the front edge of a paper roll 9 and the front edge or a cut off printing sheet 3, respectively, is still standing, and which upon command from a guide unit 10 seizes the paper and moves same through a (not illustrated) printer unit.

As paper supply is used a paper roll 9, the core diameter of which is ≧10 cm. For eliminating any risk that the paper becomes curled during printing and the transport the apparatus may have an "anti-curling" apparatus 11, which is shown more in detail in FIG. 3, and which comprises two support rolls 12 over which the paper path 13 from the roll 9 extends, and a depressor 14 which presses down the paper path 13 in an adjustable curling down operation to thereby counteract the natural-curling from the paper roll 9. The anti-curling apparatus can be mounted just in front of the entrance to the upper printer 1.

At least the upper printer 1 is formed with knives 15 which are mounted adjacent the exit 4 of the printer 1 for cuffing off the rear edge of the paper path 13 and let same slide down through a closed guide path by its own weight, or alternatively by means of one or more feeder rolls 16, and to place itself in position against the transport and pinch rolls 7, 8 of the lower printer 2 for printing of the rear side of the check print paper sheet.

As mentioned above, and as shown in FIGS. 1A and 1B the pages to be printed have to be placed in a very specific order both for the front side 1A and for the rear side 1B of the printing sheet. The set of the pages and the impositions thereof are, as known in the art, made by means of a guide unit in the form of a computer 10 to which the two printers 1 and 2 are connected. Also the actuation of the transport and pinch rolls 7 and 8 and the knives 15 are controlled by means of said computer 10. When determining the imposition the print pages of the "rear side" have to be arranged with the text turned backwards for having the sides 1-2, 3-4 etc. failing exactly opposite each other. In case some misalignment should be observed in the impositions this is corrected in the computer, and the ready printed check print sheet provides a front and rear side having fully registering sides.

The ready printed check print sheet is formed for providing, after folding, the print pages in chronologic order. The print sheet shown in FIGS. 1A and 1B is formed for being folded to sixteen pages in three steps, namely step 1 left half downwards along line "a" of FIG. 1A to 2×4+4 pages, step 2 lower half downwards following line "b" of the same figure, step 3 left half down following line "c", and page 1 shown at the top.

It should be mentioned that it is as well possible to check the impositions of the front and rear sides by means of separate check print sheets, however the check printing is made quicker from a roll of paper.

The method according to the invention is as follows:

impositions of pages to be printed are created, as known in the art, using a computer 10, with the "front side" turned right and the "rear side" with text and images turned back to front, the imposition of the "front side" is transferred to an upper printer 1, a paper roll medium is introduced in the upper printer 1 actuated by transport and pinch rolls 7, 8, the front edge of the print paper is cut off upon need, the "front page" is printed, the rear edge of the print sheet is cut off after the "front page" has been printed, the check print sheet 3 is moved in a guide path 6 directly to the entrance of a lower printer 2 and is stopped by transport and pinch rolls in said lower printer 2, the imposition for the "rear side" is rotated 180° by the computer 10, the "rear side" is printed on the check print sheet 3, visual or another checking is made of the impositions of the front and rear sides of the check print sheet connected to each other, a print original is prepared.

REFERENCE NUMERALS

1 upper printer (unit)
2 lower printer (unit)
3 check print sheet
4 exit (of 1)
5 entrance (of 2)
6 guide path
7 transport roll
8 pinch roll
9 paper roll
10 guide means (computer)
11 anti-curling apparatus
12 support rolls
13 paper path
14 depressor
15 knife
16 feeder roll(s)

The invention claimed is:

1. A method for checking a correctness of impositions and correct mutual register of the print pages at a front side and a rear side of different types of printed matters using a check print apparatus comprising two co-operating printers, said method comprising:

preparing impositions in a control unit of the front side and the rear side of a print original to be made;

feeding paper from a roll of paper into an upper printer of the two printers by a roll feeder;

printing a plurality of print pages having a first imposition of the front side of the paper;

allowing the paper to be placed in a correct feeding position of a lower printer of the two printers provided underneath the upper printer and turned 180° about a vertical axis, wherein the paper always remains above a paper entrance of the lower printer on its way from the upper printer to the lower printer;

printing a plurality of print pages having a second imposition on the rear side of the paper with the page in position turned 180°;

checking that the first and second impositions printed on the front and rear sides coincide;

correcting the first and second impositions using the control unit when the checking step determines the first and second impositions do not coincide; and preparing a print original information based on the first and second impositions coinciding and the correcting step, the print original information being used to print the print original in a main printing device.

2. The method according to claim 1, wherein a front edge of the paper which has been printed in the upper printer is seized and is introduced into the lower printer by transport and pinch rolls.

3. The method according to claim 1, wherein the paper is rolled off the roll of paper and passed through an anti-curling device for eliminating eventual curling of the paper path.

4. A printing method, comprising:

printing a plurality of first pages on a first side of a paper in accordance with a first imposition;

printing a plurality of second pages on a second side of the paper in accordance with a second imposition;

determining if the plurality of first pages are properly imposed over the plurality of second pages such that when the paper is folded and cut, the plurality of first and second pages coincide; and changing the first and second impositions such that plurality of first and second pages coincide if the determining step determines the plurality of first and second pages do not coincide;

feeding the paper from a roll of paper into an upper printer to thereby print the plurality of first pages on the first side of the paper; and guiding the paper to a lower printer provided underneath the upper printer and turned 180° about a vertical axis to thereby print the plurality of second pages on the second side of the paper, wherein the paper always remains above a paper entrance of the lower printer on its way from the upper printer to the lower printer, wherein the determining step is performed by visually checking the printed paper to determine if the plurality of first pages are properly imposed over the plurality of second pages, and wherein a print original information is prepared based on a result from the determining step and the changing step, the print original information being used to print a print original in a main printing device.

5. The method according to claim 4, wherein the sliding step comprises allowing the paper to slide through a closed guide path by its own weight or by using feeder rolls.

6. The method according to claim 4, wherein the first and second impositions are preset on a computer.

7. The method according to claim 4, wherein a front edge of the paper which has been printed in the upper printer is seized and is introduced into the lower printer via transport and pinch rolls.

8. The method according to claim 4, further comprising: passing the paper through an anti-curling device immediately after leaving the roll and before entering the upper printer to prevent the paper from curling.

9. The method according to claim 4, wherein a computer is connected to the upper and lower printers to thereby set the first and second impositions, respectively.

10. The method according to claim 4, wherein the guiding step includes sliding the paper to the lower printer.

* * * * *